United States Patent [19]

Bestel

[11] Patent Number: 4,871,888

[45] Date of Patent: Oct. 3, 1989

[54] TUBULAR SUPPORTED AXIAL MAGNETIC FIELD INTERRUPTER

[76] Inventor: Ernest F. Bestel, 10584 W. Cortez Circle, Franklin, Wis. 53132

[21] Appl. No.: 213,040

[22] Filed: Jun. 29, 1988

Related U.S. Application Data

[63] Continuation-in-part of Ser. No. 156,251, Feb. 16, 1988, Pat. No. 4,839,481.

[51] Int. Cl.[4] ..... H01H 33/66

[52] U.S. Cl. ..... 200/144 B

[58] Field of Search ..... 200/144 B

[56] References Cited

U.S. PATENT DOCUMENTS 3,244,843 4/1966 Ross ..... 200/144 B 4,117,288 9/1978 Gorman et al. ..... 200/144 B

*Primary Examiner*—Robert S. Macon

*Attorney, Agent, or Firm*—Michael F. Heim

[57] ABSTRACT

A cylindrical coil conductor incorporated in a vacuum interrupter comprises a cylindrical body with a plurality of inclined slits therein defining a plurality of current paths. The coil conductor is uniformly cylindrical to reduce radial magnetic fields, which tend to cancel the axial magnetic field generated by the coil conductor. The cylindrical coil conductor electrically connects to a conductor disk and to a main electrode and the conductor disk electrically connects to a conductor rod. A support rod attaches to the main electrode and extends through the coil conductor and conductor disk to reduce mechanical stress on the coil conductor. A second cylindrical coil conductor is mounted in an opposing manner with inclined slits defining current paths in parallel to the slits in the first coil conductor. The current paths in the two coil conductors comprise one-turn current flow generating a uniform axial magnetic field to permit uniform distribution of the arc current between the main electrodes.

11 Claims, 2 Drawing Sheets

TUBULAR SUPPORTED AXIAL MAGNETIC FIELD INTERRUPTER

CROSS-REFERENCE TO RELATED APPLICATION

This application is a continuation-in-part of co-pending U.S. Pat. application Ser. No. 156,251 filed by William H. Nash and Ernest F. Bestel on Feb. 16, 1988 and assigned to the assignee of this application, now U.S. Pat. No. 4,839,481.

BACKGROUND OF THE INVENTION

The present invention relates to a vacuum interrupter and more particularly to an improved electrode structure for a vacuum interrupter. Still more particularly, the invention relates to an improved tubular coil conductor forming a part of the electrodes for a vacuum interrupter.

A vacuum interrupter for handling a high current generally includes a pair of main electrodes disposed in a vacuum vessel so that at least one of the pair is movable toward and away from the other, coil conductors mounted on the rear surfaces of the main electrodes, and conductor rods extending to the exterior of the vacuum vessel from the rear surfaces of the coil conductors. Current flows from one of the conductor rods to the other through the coil conductors and main electrodes. When one of the conductor rods is urged by an actuator for the purpose of interrupting the current, at least one of the main electrodes is moved away from the other, and an arc current is caused to flow between the spaced electrodes. This arc current is dispersed into a plurality of filament-like arc currents by a magnetic field created by the flow current through the coil conductors.

U.S. Pat. No. 3,946,179 discloses a coil conductor that comprises a plurality of conductive arms connected to arcuate sections. The arms connect at one end to a conductor rod and diverge in a generally radial direction therefrom to connect to an arcuate section at the other end. The arcuate sections extend circumferentially from the arms and connect to a main electrode. A plurality of arms and associated arcuate sections with clearances formed between adjacent arcuate sections, form an imaginary coil of one turn. Current flows from the rod to the main electrode through the spaced arms and associated arcuate sections. The one-turn current produces a uniform axial magnetic field that produces the diffuse, filamentary arc currents between the main electrodes.

The use of the clearance in U.S. Pat. No. 3,946,179 to produce the coil effect in the coil conductor results in a weak axial magnetic field in the region of the clearances. Arc currents have a tendency to migrate from a low intensity region toward a high intensity region of an axial magnetic field. Thus, the arc current flowing into the main electrode migrates away from the region of the clearances, causing localized overheating of the main electrode. In addition, because the entire area of the main electrode cannot be utilized effectively for the current interruption, it becomes necessary to increase the size of the main electrode.

In commonly assigned U.S. Ser. No. 156,251, a uniform axial magnetic field is produced by providing parallel slits in the coil conductors. However, the configuration of the coil conductors still provide certain limitations in the size of the axial magnetic field that may be generated. The axial magnetic field is partially cancelled by a radial magnetic field, which is generated by current flow through the bottom of the diverging coil conductors. Furthermore, the structure of the coil conductors may be susceptible to mechanical fatigue.

SUMMARY OF THE INVENTION

Accordingly, there is provided herein a small, compact vacuum interrupter that operates with an improved current interruption performance. The improved vacuum interrupter includes an electrode structure with a tubular coil conductor for increasing the axial magnetic field within the vacuum vessel. The coil conductor has a generally uniform cylindrical configuration enclosed at one end thereof by a conductor disk, which adjoins an external conductor rod. The generally uniform cylindrical configuration reduces the radial magnetic field generated by prior art coil conductors and thereby eliminates undesirable cancellation of the axial magnetic field. A number of electrical connectors extend from the opposing end of the tubular electrode structure for providing current to the main electrode. The coil conductor includes a plurality of inclined slits, at least two, formed on a cylindrical body, defining separate current paths of approximately one-half turn each around the circumference of the cylindrical coil conductor. Current flows axially through the external conductor rod, radially through the conductor disk, and then axially through the coil conductor and the several current paths defined thereon.

Two substantially identical electrode structures are provided in the vacuum vessel so that the inclined slits on each of the opposing coil conductors are generally parallel. Thus, current flows from a first external conductor rod, through a first conductor disk, and then through the several current paths defined by the coil conductor to an electrical connector. At the connector, the current passes from a first main electrode to the opposing electrode structure, which is, in effect, a mirror image of the first electrode structure. The slits and current paths on the two opposing conductor coils are aligned such that the current effectively flows through one full turn as it passes through the vacuum vessel. Consequently, a strong, uniform axial magnetic field is applied to the two main electrodes, and current arcing between the spaced main electrodes can be more uniformly distributed over the entire surfaces of the main electrodes.

The electrode structures of the improved vacuum interrupter also include a structure support rod that extends axially from the main electrode, through the tubular coil conductor, and co-axially within the external conductor rod. The support rod reduces mechanical stress on the tubular coil and concentrically aligns the electrode structure, thereby maintaining the integrity of the current paths around the coil conductor. These and various other characteristics and advantages of the present invention will become readily apparent to those skilled in the art upon reading the following detailed description and claims and by referring to the accompanying drawings.

BRIEF DESCRIPTION OF THE DRAWINGS

For a more detailed description of the preferred embodiment of the invention, reference will now be made to the accompanying drawings, wherein.

DETAILED DESCRIPTION OF THE PREFERRED EMBODIMENT

Figure 1:
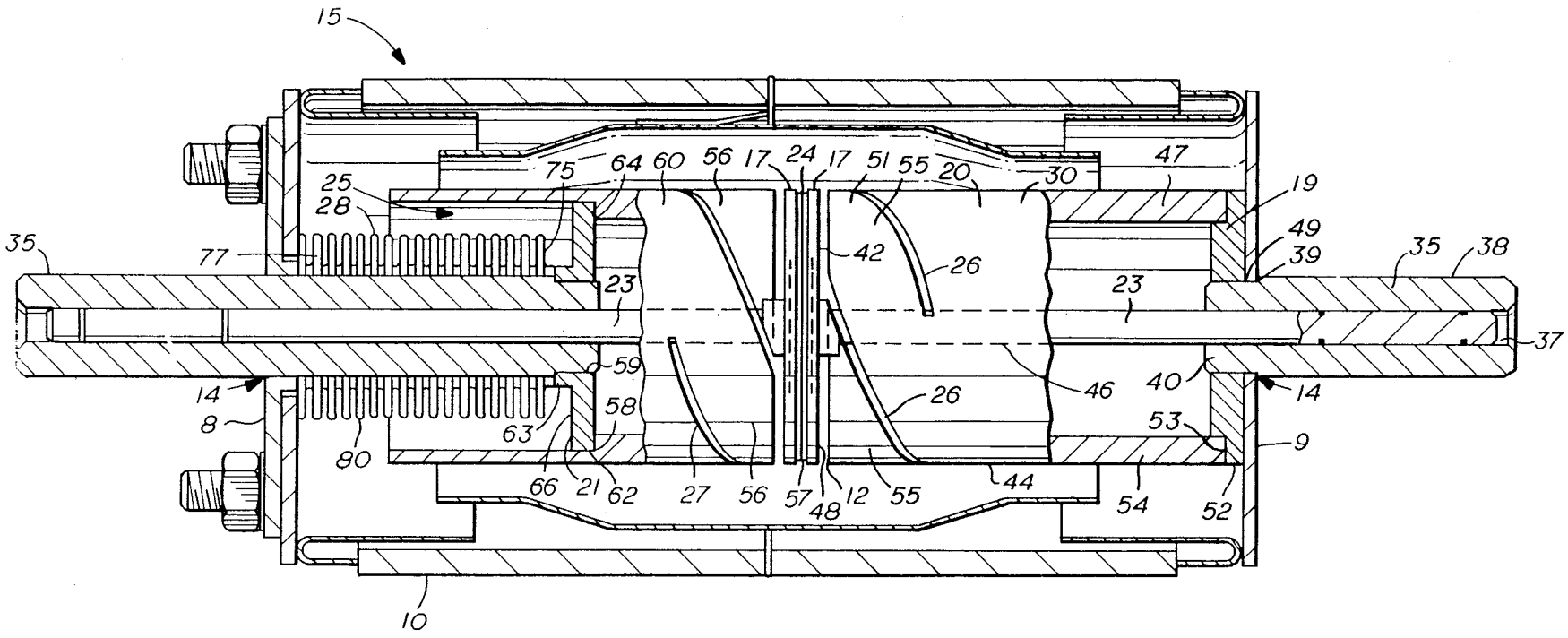
FIG. 1 is a partly sectional, schematic side elevation view of a vacuum interrupter constructed in accordance with the present invention.

The vacuum interrupter of the present invention comprises an improved design of the interrupter disclosed in commonly assigned U.S. Ser. No. 156,251, which is hereby incorporated by reference herein. Referring now to FIG. 1, a vacuum interrupter constructed in accordance with the preferred embodiment of the present invention, includes a vacuum vessel 15, a movable electrode structure 25 displaced along the central axis of vessel 15, a stationary electrode structure 30 disposed along the central axis of the vacuum vessel 15 opposite the movable electrode structure 25, and a bellows 28 for displacing the movable electrode structure 25 axially within the vessel 15. Displacing the movable electrode structure 25 from the stationary electrode structure 30 causes current flowing between the two electrode structures to arc across the gap between the structures, as discussed more fully herein.

Referring still to FIG. 1, vacuum vessel 15 preferably comprises a pair of end plates 8, 9 mounted on both ends of a cylindrical member 10. End plates 8, 9 have a generally circular configuration with a radius r and a central circular aperture 14 therethrough. Cylindrical member 10 also has a radius r and is constructed of an electrically insulative material. End plates 8, 9 fixedly attach to and enclose both ends of cylindrical member 10 to define a controlled environment within the vessel 15.

Figure 2:
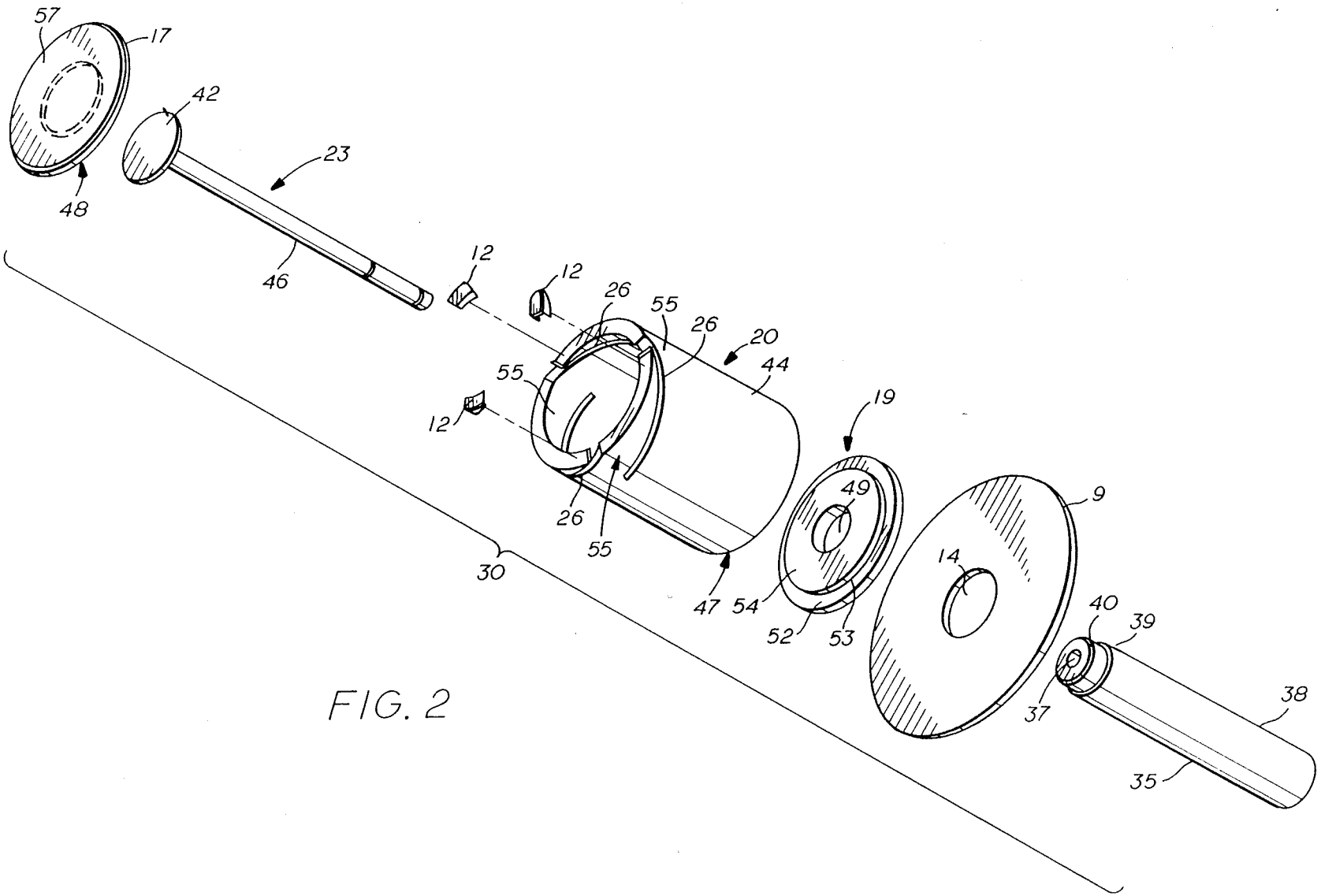
FIG. 2 is a perspective view of one of the two electrode structures incorporated in the vacuum interrupter shown in FIG. 1.

Referring now to FIGS. 1 and 2, the stationary electrode structure 30 constructed in accordance with the preferred embodiment comprises an external conductor rod 35 extending through the central aperture 14 of end plate 9, a conductor disk 19, a tubular coil conductor 20 electrically connected at one end to disk 19, a main electrode 17 electrically connected to coil conductor 20 and a structural support rod 23 extending along the central axis of the electrode structure 30.

The external conductor rod 35 is constructed of an electrically conductive material and includes an external end 38, an internal end 40 having an outer diameter slightly less than that of the external end, and a circumferential lip 39 defined by the juncture of the external and internal ends 38, 40. The conductor rod 35 also includes a central bore 37 extending axially through the rod 35. Upon assembly, the lip 39 engages the end plate 9 adjacent to the central aperture 14 with the external end 38 of rod 35 extending therefrom externally of the vacuum vessel 15 and the internal end 40 of the rod 35 protruding through aperture 14 into the interior of vacuum vessel 15 along the central axis of the vessel. The central bore 37 receives one end of the structural support rod 23 to concentrically align and mechanically support the electrode structure.

The conductor disk 19 comprises a generally cylindrical plate of electrically conductive material having a first outer diameter approximately the same as the outer diameter of the coil conductor 20 and a second outer diameter slightly less than the inner diameter of the coil conductor 20 so as to define a shoulder 53 for engaging one end of the conductor coil 20. Conductor disk 19 also includes an axially extending aperture 49 for receiving therethrough the internal end 40 of the conductor rod 35.

The conductor disk 19 fixedly attaches to the end plate 9 with the aperture 49 thereof co-axially aligned with central aperture 14 of end plate 9. The internal portion 40 of rod 35 extends through the aperture 49 of the conductor disk 19 to give the electrode structure 30 structural stability.

Referring still to FIGS. 1 and 2, the tubular coil conductor 20 constructed in accordance with the preferred embodiment comprises a uniform cylindrical structure 44 with an external end 47 engaging the shoulder 53 of the conductor disk 19, an internal end 51, and a plurality of inclined slits 26 machined into the cylindrical structure 44. Cylindrical structure 44 is constructed of an electrically conductive material having a generally fixed radius, and connects electrically to conductor disk 19. Slits 26 extend from the internal end 51 of cylindrical structure 44 and spiral approximately 180° along the circumference of the cylindrical structure 44. The plurality of slits 26 are generally equally spaced along the surface of the cylindrical structure 44 to define a plurality of current paths 55 of approximately one-half turn each about the circumference of the tubular coil conductor 20. In the preferred embodiment of FIG. 2, three slits 26 are provided defining three current paths 55. However, any number of slits 26 (greater than two) may be provided. The angle of incidence between each slit 26 and the interior end 51 of coil 20 may be arbitrarily chosen, but in the preferred embodiment, is approximately 20 degrees.

The interior end 51 of tubular coil conductor 20 electrically connects to the main electrode 17 through a plurality of electrical connectors 12 associated one each with a respective current path 55. As shown in the preferred embodiment of FIG. 2, connectors 12 may comprise electrically conducting clips permanently mounted to the interior end 51 of coil conductor 21 at the end of current path 55 adjacent to slit 26. Alternatively, connectors 12 may comprise integral projections formed on the interior end 51 of coil conductor 20 or on the adjoining surface of the main electrode 17, as described in commonly assigned U.S. Ser. No. 156,251.

Referring still to FIGS. 1 and 2, the main electrode 17 comprises an electrically conductive circular disk that connects electrically to electrical connectors 12 of coil conductor 20. Main electrode 17 has a diameter approximately equal to the diameter of coil conductor 20 and defines an interior surface 57 facing the main electrode 17 of the opposing electrode structure and a back surface 48 facing the interior end 51 of coil conductor 20 and adjoining electrical connectors 12.

Referring still to FIGS. 1 and 2, structural support rod 23 is constructed of a high dielectric material and includes a cap 42 fixedly attached to the back surface 48 of main electrode 17 and a rod portion 46 extending through the electrode structure 30, along the central axis of vessel 15. Cap 42 has a diameter somewhat less than that of coil conductor 20 and main electrode 17. Rod portion 46 of support rod 23 has a diameter slightly less than the inner diameter of the bore 37 in conductor rod 35. The rod portion 46 extends through coil conductor 20, conductor disk 19, end plate 9 and into bore 37 in external conductor rod 35, thereby co-axially aligning electrode structure 30 and reducing stress on coil conductor 20 and main electrode 17.

Referring now to FIG. 1, movable electrode structure 25 is constructed in a manner substantially the same as the stationary electrode structure 30 described supra. One difference, however, relates to the structure of the conductor disk and the coil conductor 20. Movable electrode structure 25 comprises an external conductor rod 35' extending through the central aperture 14 of end plate 8, a conductor disk 21, a tubular coil conductor 60 electrically connected to disk 21, a main electrode 17' electrically connected to coil conductor 60 and a structural support rod 23' extending through the central axis of the electrode structure 25. The external conductor rod 35', main electrode 17' and structural support rod 23' are constructed in accordance with the description supra of the stationery electrode structure 30.

Referring still to FIG. 1, the conductor disk 21 and tubular coil conductor 60 also are constructed in accordance with the description supra of the electrode structure 30, except that the conductor disk 21 is of a uniform diameter (devoid of shoulder 53 on disk 19) and exterior end of the coil conductor 60 includes an inner diameter slightly greater than the outer diameter of the conductor disk 21 and somewhat greater than the inner diameter of the inter end of the conductor 60, thereby defining a circumferential shoulder 58 on the inner surface of the conductor 60 approximately halfway between the exterior and interior ends of the conductor 60. Conductor disk 21 of movable electrode structure 25 further comprises an interior face 64, an exterior face 66, an aperture 59 extending axially therethrough, and a circumferential lip 63 protruding from the exterior face 66 about the aperture 59 for engaging bellows 28. Aperture 59 receives therethrough conductor rod 35', with circumferential lip 63 engaging rod 35'. Conductor disk 21 abuts the inner surface coil conductor 60, with the outer periphery of interior face 64 being fixedly attached to the shoulder 58 of coil conductor 60. The circumferential lip 63 is received within the bellows 28.

The bellows 28 is any conventional bellows assembly having an interior end 75 engaging conductor disk 21, an exterior end 77 mounted to end plate 8, and a body portion 80 through which external conductor rod 35' extends. Interior end 75 receives therein circumferential lip 63 of conductor disk 21. A majority of the body portion 80 lies within the coil conductor 60, thereby shielding the bellows from the electric fields within the vessel 15. The bellows drives an actuator (not shown) mounted on the rod 35' to move rod 35' axially.

Tubular coil conductor 60 of movable electrode 60, like coil conductor 20, comprises a plurality of slits 27 and electrical connectors 24 defining a plurality of current paths 56. As disclosed in commonly assigned U.S. Ser. No. 156,251, the inclined slits 26, 27 are positioned approximately parallel to one another, with electrical connectors 12, 24 directly aligned. In operation, when the movable electrode structure 25 parts from stationery electrode structure 30 to interrupt current flow, an arc current flows across the electrode structures 25, 30. Current flows through one turn by passing through one current path 55, through connector 12, main electrode 17, through connector 24 and through current path 56.

Due to the uniformly cylindrical configuration of the tubular coil conductors, the radial magnetic field is reduced, thereby eliminating significant cancellation of the axial magnetic field. In addition, more slits 26, 27 may be provided to further limit the generation of radial magnetic fields by the coil conductors 20, 60.

While a preferred embodiment of the invention has been shown and described, modifications can be made by one skilled in the art without departing in substance from the spirit of the invention.

What is claimed is:

1. A vacuum interrupter, comprising:

a first electrode structure disposed in a vacuum vessel, said first electrode structure having a main electrode;

a second electrode structure disposed within the vacuum vessel, said second electrode structure having a main electrode;

means for moving at least one of said first and second electrode structures axially of the other;

means for generating an axial magnetic field about the main electrodes of said first and second electrode structures, said field generating means minimizing radial components of the magnetic field to enhance uniformity of distribution of current arcing between the main electrodes when said first and second electrode structures are parted, wherein said generating means includes a support rod attached to the main electrode of said first electrode structure and extending through said first electrode structure.

2. A vacuum interrupter according to claim 1, wherein said field generating means comprises:

a generally cylindrical conductor having a first end and a second end;

a plurality of inclined slits in the first end of said cylindrical conductor, said slits being spaced one from the next and extending generally circumferentially from the first end of said cylindrical conductor at an acute angle thereto; and a conductor disk enclosing and electrically connected to the second end of said cylindrical conductor, whereby said plurality of slits define coil-like current paths that generate an axial magnetic field which, because of the cylindrical configuration of said cylindrical conductor, has a minimal radial component.

3. A vacuum interrupter, comprising:

a first electrode structure disposed in a vacuum vessel; and a second opposed electrode structure disposed within the vacuum vessel, said second electrode structure being axially movable toward and away from said first electrode structure;

said first electrode structure and said second electrode structure each including a uniformly cylindrical coil conductor, wherein said first electrode structure and said second electrode structure further comprise;

a conductor disk electrically connected to the cylindrical coil conductor;

a main electrode electrically connected to the electrical connectors; and a support rod attached to the main electrode and extending through the cylindrical coil conductor and the conductor disk.

4. A vacuum interrupter according to claim 3 wherein said cylindrical coil conductors include a plurality of inclined slits defining a plurality of current paths.

5. A vacuum interrupter according to claim 4, wherein said first electrode structure and said second electrode structure include a plurality of electrical connectors positioned at an end of the cylindrical coil conductor with one electrical connector associated with each current path.

6. A vacuum interrupter according to claim 5, wherein each current path defines a half turn on the cylindrical coil conductor.

7. A vacuum interrupter according to claim 6, wherein the plurality of inclined slits on said first electrode structure are positioned substantially in parallel with the plurality of inclined slits on said second electrode structure.

8. A vacuum interrupter according to claim 7, wherein the plurality of electrical connectors on said first electrode structure substantially align with the plurality of electrical connectors on said second electrode structure.

9. A vacuum interrupter, comprising:

a vacuum vessel with a first end plate and a second end plate;

a first conductor disk;

a first tubular coil conductor electrically connected to said first conductor disk, said first tubular coil conductor including a plurality of inclined slits on a portion of said first tubular coil conductor, defining a plurality of current paths through said first tubular coil conductor, with an electrical connector positioned at the end of each current path;

a first main electrode electrically connected to the electrical connectors;

a first connector rod extending through the first end plate and first conductor disk;

a first support rod attached to the first main electrode and extending through said first coil conductor and received within said first connector rod;

a second main electrode positioned adjacent said first main electrode;

a second tubular coil conductor electrically connected to said second main electrode, said second tubular coil conductor including a plurality of inclined slits on a portion of said second tubular coil conductor, defining a plurality of current paths through said second tubular coil conductor;

a second conductor disk electrically connected to said second tubular coil conductor;

a second conductor rod extending through said second end plate and said second tubular coil;

a second support rod attached to said second main electrode and extending through said second coil conductor and received within said second conductor rod.

10. A vacuum interrupter according to claim 1, wherein said support rod is constructed of a dielectric material.

11. A vacuum interrupter according to claim 3, wherein said support rod is constructed of a dielectric material.

* * * * *